US009434453B2

(12) United States Patent
Gonzales, III

(10) Patent No.: US 9,434,453 B2
(45) Date of Patent: Sep. 6, 2016

(54) SWIVELING SEAT INSERT FOR KAYAKS

(71) Applicant: Donald Edward Gonzales, III, Homestead, FL (US)

(72) Inventor: Donald Edward Gonzales, III, Homestead, FL (US)

(73) Assignee: SWIVEL POD 360, LLC, Miami, FL (US)

( * ) Notice: Subject to any disclaimer, the term of this patent is extended or adjusted under 35 U.S.C. 154(b) by 0 days.

(21) Appl. No.: 14/565,347

(22) Filed: Dec. 9, 2014

(65) Prior Publication Data

US 2015/0158561 A1 Jun. 11, 2015

Related U.S. Application Data

(60) Provisional application No. 61/913,446, filed on Dec. 9, 2013.

(51) Int. Cl.
*B63B 29/04* (2006.01)
*B63B 35/71* (2006.01)

(52) U.S. Cl.
CPC ..... *B63B 35/71* (2013.01); *B63B 2029/043* (2013.01); *B63B 2035/715* (2013.01)

(58) Field of Classification Search
CPC ..... B63B 2029/043; B63B 29/04
See application file for complete search history.

(56) References Cited

U.S. PATENT DOCUMENTS

| | | | | |
|---|---|---|---|---|
| 4,398,766 | A * | 8/1983 | Everett | B63B 29/04 114/363 |
| 5,209,178 | A * | 5/1993 | Rowe | B60N 2/32 114/363 |
| 7,753,444 | B2 * | 7/2010 | Vallentin | B60N 2/2821 297/256.12 |
| 2010/0045078 | A1 * | 2/2010 | Lee | A47C 7/407 297/118 |
| 2013/0189885 | A1 * | 7/2013 | Wood | B63B 29/04 441/74 |

* cited by examiner

*Primary Examiner* — Edwin Swinehart

(57) ABSTRACT

A swiveling seat insert for kayaks allows a kayak user to physically turn their entire body while sitting in a kayak in order to gain a more advantageous body position for performing activities while using the kayak or for increased range of viewing angles.

4 Claims, 5 Drawing Sheets

SWIVELING SEAT INSERT FOR KAYAKS

The current application claims a priority to the U.S. Provisional Patent application Ser. No. 61/913,446 filed on Dec. 9, 2013.

FIELD OF THE INVENTION

The present invention relates generally to kayaks. More particularly, the present invention relates to kayak seats.

BACKGROUND OF THE INVENTION

A kayak is a small, narrow boat primarily designed to be manually propelled by means of a double-bladed paddle, a pedal mechanism or a trolling motor. Modern kayaks serve diverse purposes, ranging from slow and easy touring on placid water, to racing and complex maneuvering in fast-moving whitewater, to fishing and long-distance ocean excursions, and vary in design according to their application.

When in a kayak, a user's visibility is limited since the user's body is locked in a straight forward position. In this position, the user has a severely limited turn radius and is therefore impeded from performing actions to the sides or rear of the kayak. Additionally, the user has a limited field of view and must be extremely flexible in order to turn enough to see behind them. This can be a significant safety issue when crossing boat channels and in other situations such as attempting to ascertain the position of other people, vessels or geographical features in the vicinity. Another problem is that occasionally a kayak user who is fishing may wish to tie off in a narrow creek or mangrove tunnel, through which current is typically running. Upon tying off, the current begins to spin the kayak to face the current. This can pose issues for fishing as the user may be forced to cast their line backwards and hold the rod behind them, which can be very awkward and uncomfortable.

It is therefore an object of the present invention to provide a seat insert which can be utilized with any existing kayak and which allows the kayak user to swivel their body while sitting in the kayak in order to achieve a comfortable body position for visually surveying their environment and performing actions at any angle. The insert is easily removable allowing the user to sit in the kayak conventionally in its original condition, and is also buoyant to act as a flotation device if necessary.

DETAIL DESCRIPTIONS OF THE INVENTION

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced without the implementation of some features as they are described. It should be understood that some details have not been described in detail in order to not unnecessarily obscure focus of the invention.

Figure 1:
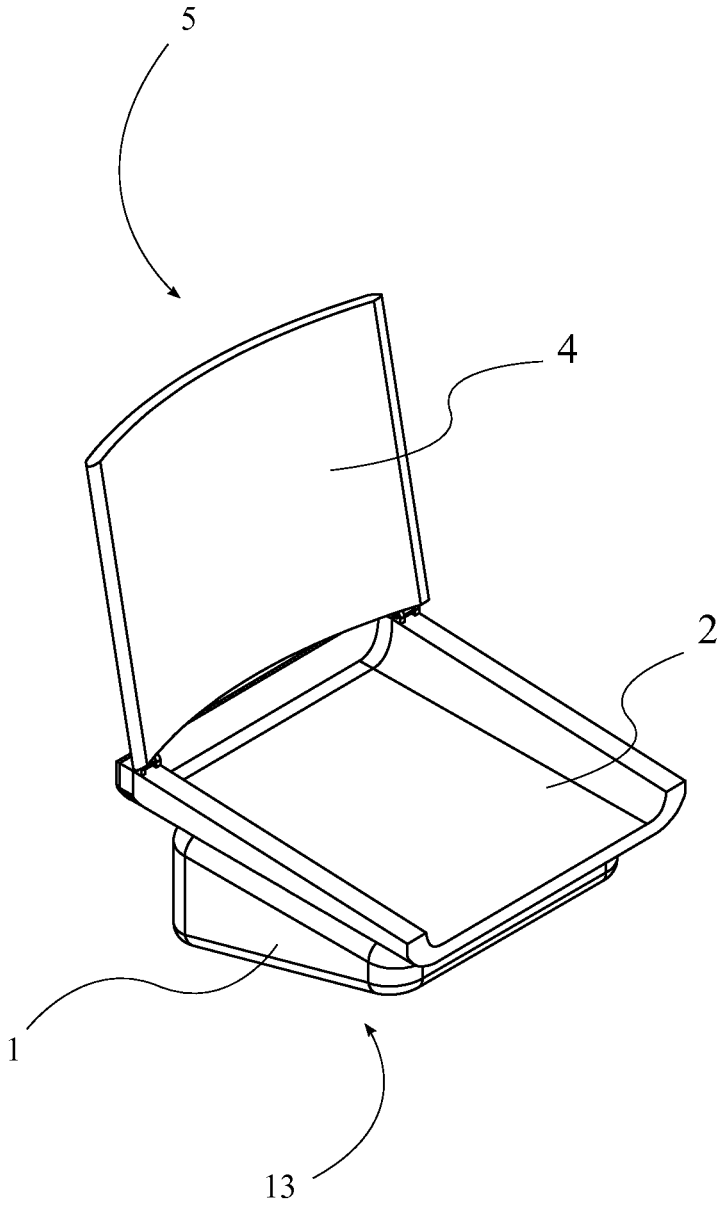
FIG. 1 is a perspective view of one embodiment of the present invention.
Figure 2:
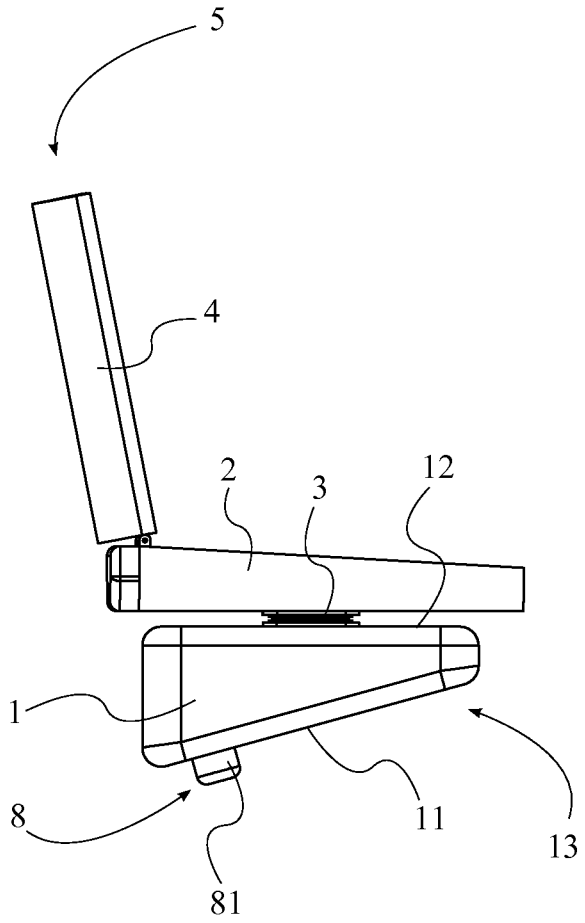
FIG. 2 is a side view of one embodiment of the present invention.
Figure 3:
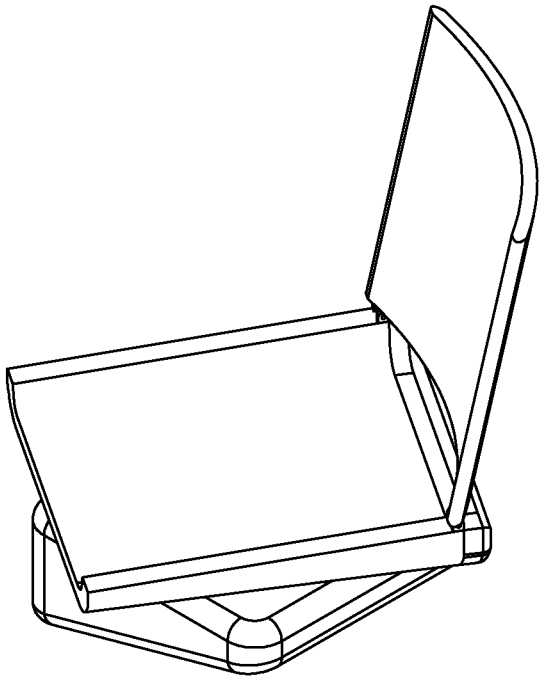
FIG. 3 is a perspective view of one embodiment of the present invention where the seat has been swiveled.
Figure 4:
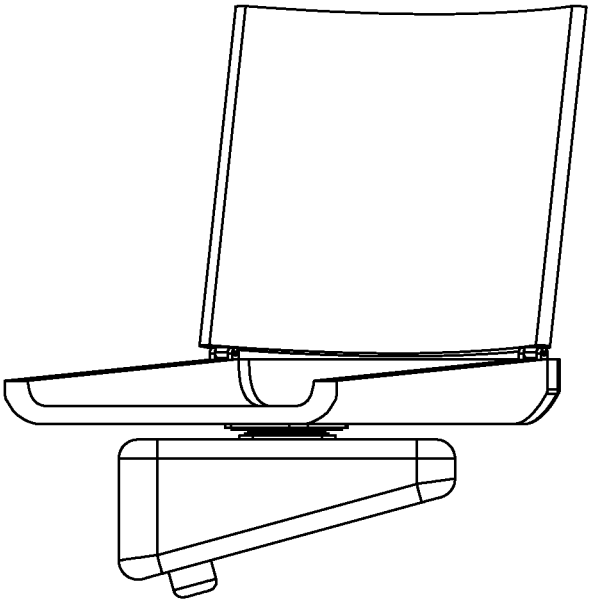
FIG. 4 is a side view of one embodiment of the present invention where the seat has been swiveled.

The present invention is a swiveling seat insert for kayaks which allows the user to turn their body in place in order to gain a better view or body position while sitting in the kayak. Referring to FIGS. 1-2, the preferred embodiment of the present invention generally comprises a base 1, a seat 2, and a swivel interface 3. The seat 2 is pivotally connected to the base 1 through the swivel interface 3, so that the seat 2 may freely swivel relative to the base 1 about a vertical axis. The present invention is shown in a swiveled position in FIGS. 3-4. The base 1 comprises a kayak-seat insertable portion 11 and a seat support portion 12, which are positioned opposite each other on the base 1. The seat 2 is supported offset from the base 1 by the swivel interface 3 adjacent to the seat support portion 12 so that the swiveling action of the seat 2 is not impeded by friction or other contact between the seat 2 and the base 1. In the preferred embodiment of the present invention, the seat 2 is removable from the base 1 by any useful fastening mechanism, ideally by the swivel interface 3 being a type of interface that accommodates swiveling and being removable. This is beneficial for transport and storage purposes, and additionally allows users to customize the present invention by substituting various embodiments of the base 1 and the seat 2 for different combinations. This may be useful for users with multiple kayaks with different kayak-seat profiles, or for allowing multiple seats to be used with the same kayak. However, this is not specifically required, and in an alternate embodiment the seat 2 is fixed to the base 1 through the swivel interface 3 and not easily removable short of dismantling the swivel interface 3.

Additionally, it is contemplated that some embodiments may also employ other adjustment mechanisms, such as, but not limited to, means for tilting the seat 2, sliding the seat 2 forward or backward, or locking the seat 2 in a specific angular orientation.

Figure 5:
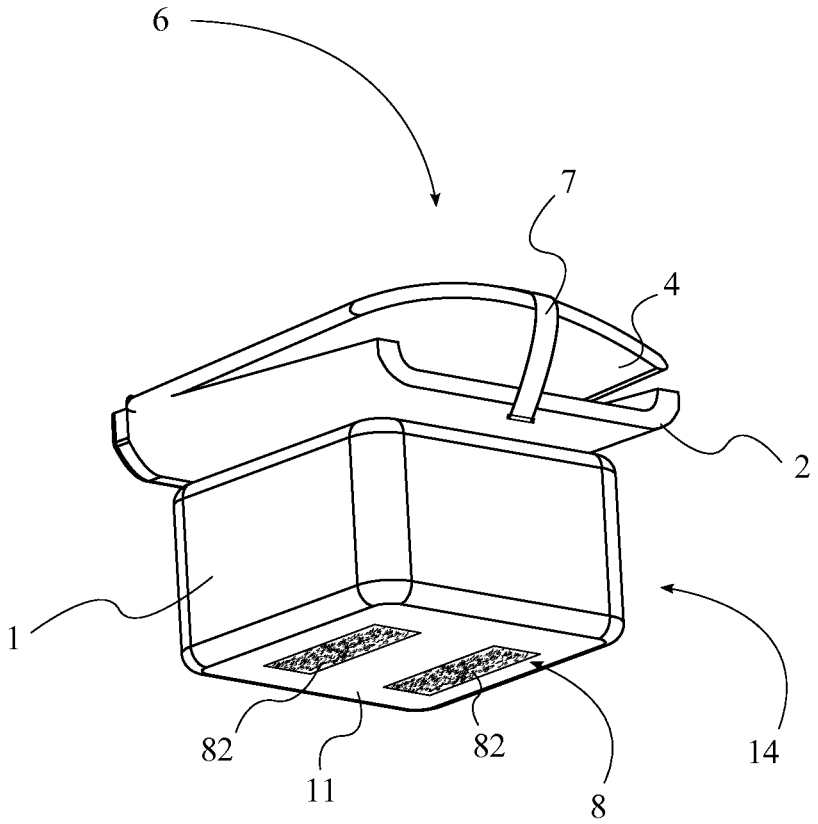
FIG. 5 is a lowered perspective view of another embodiment of the present invention.

The kayak-seat insertable portion 11 is the lower surface of the base 1 and the seat support portion 12 is the upper surface of the base 1. The seat 2 is positioned adjacent to the seat support portion 12. The kayak-seat insertable portion 11 is placed into the kayak seat, and should comprise a shape that conforms to the shape of the kayak seat. Since various models of kayaks comprise various seat 2 designs, the kayak-seat insertable portion 11 must be customized for whichever particular kayak the present invention is to be utilized with. In one embodiment of the present invention, the kayak-seat insertable portion 11 comprises a wedge shape 13 as shown in FIGS. 1-2. In another embodiment, the kayak-seat insertable portion 11 comprises a cuboid shape 14, as shown in FIG. 5. The cuboid shape 14 is typically better suited for sit on top kayaks with flat decks, sit-in kayaks, or potentially even stand-up paddle boards. Another possible option is that the kayak-seat insertable portion 11 may be made of a yielding material that conforms to any shape.

The seat support portion 12 is the upper surface of the base 1 to which the swivel interface 3 is connected. The purpose of the base 1 is essentially to act as an adapter between the shape of the kayak seat and a flat surface for supporting the seat 2. When the present invention is inserted into a kayak seat, the seat support portion 12 should be horizontal. The seat support portion 12 should ideally be flat in the preferred embodiment, though this is not necessarily required so long as the connections between the seat support portion 12, the swivel interface 3 and the seat 2 result in the seat 2 having a generally horizontal orientation. However it is contemplated that in alternate embodiments, a tilting or reclining mechanism may be included so that the user has the option to recline in the seat 2.

The preferred embodiment of the present invention additionally comprises a seat back 4 which is connected to the seat 2 opposite the base 1 against which the user may lean when sitting in the seat 2. In the preferred embodiment, the seat back 4 is hingedly connected to the seat 2 so that the seat back 4 may be folded between an open position 5 and a closed position 6. The open position 5 is shown in FIGS. 1-2 and the closed position is shown in FIG. 5. This folding action is beneficial for transport and storage. Additionally, the preferred embodiment further comprises a seat back fastener 7 shown in FIG. 5 which is removably attached between the seat 2 and the seat back 4 or between the base 1 and the seat back 4 in the folded position so that the seat back 4 is prevented from accidentally hinging into the open position 5.

Preferably, the base 1 comprises a kayak-seat fastener 8 so that the kayak-seat insertable portion 11 may be removably attached within the kayak seat by the kayak-seat fastener 8. While the present invention may function simply by having the base 1 rest in the kayak seat without any securing means, it is more desirable to have a means for securing the base 1 within the kayak seat so that the user is more secure when utilizing the present invention. In one embodiment, the kayak-seat fastener 8 comprises a plurality of knobs 81 which are connected to the kayak-seat insertable portion 11 of the base 1. This configuration is designed to match one common kayak seat configuration, where the said kayak seat configuration has a plurality of depressions in which the plurality of knobs 81 may rest in order to more adequately secure the base 1 to the kayak seat. In another embodiment, the kayak-seat fastener 8 comprises strips of hook and loop tape 82, also known as Velcro, or only the hook portion or the loop portion of a set of hook and loop tape 82, where mating strips of hook and/or loop tape are affixed to the kayak seat. In other embodiments, any other appropriate means may be comprised for the kayak-seat fastener 8, such as, but not limited to, button snaps, fasteners such as screws or clamps, straps, or other means.

In the preferred embodiment, the base 1, the seat 2, and the seat back 4 are made of a buoyant material such as, but not limited to, fiberglass, high density foam, wood, or polyurethane—preferably similar material to that utilized in typical kayak construction. This allows the present invention to function as a personal flotation device in the event of capsizing where the user may not be able to reach the kayak itself but is able to grasp the present invention and thus remain afloat.

Although the invention has been explained in relation to its preferred embodiment, it is to be understood that many other possible modifications and variations can be made without departing from the spirit and scope of the invention as hereinafter claimed.

What is claimed is:

1. A swiveling seat insert for kayaks comprises:
- a base;
- a seat;
- a swivel interface;
- the base comprises a kayak-seat insertable portion and an seat support portion;
- the kayak-seat insertable portion and the seat support portion being positioned opposite each other on the base;
- the seat being positioned offset from the base adjacent to the seat support portion;
- the seat being pivotally connected to the base through the swivel interface;
- a seat back;
- the seat back being connected to the seat opposite the base;
- the seat back being hingedly connected to the seat, wherein the seat back may be folded between an open position and a closed position;
- a seat back fastener;
- the seat back fastener being removably attached between the seat and the seat back in the closed position;
- the base being made of a buoyant material;
- the base comprises a kayak-seat fastener, wherein the kayak-seat insertable portion is removably attached within a kayak seat by the kayak-seat fastener;
- the kayak-seat fastener comprises a plurality of knobs; and
- the plurality of knobs being connected to the kayak-seat insertable portion of the base.

2. The swiveling seat insert for kayaks as claimed in claim 1 comprises:
- the seat being removably connected to the base.

3. The swiveling seat insert for kayaks as claimed in claim 1 comprises:
- the base comprises a wedge shape.

4. The swiveling seat insert for kayaks as claimed in claim 1 comprises:
- the base comprises a cuboid shape.

* * * * *